US005366765A

United States Patent [19]

Milaniak et al.

[11] Patent Number: 5,366,765

[45] Date of Patent: Nov. 22, 1994

[54] AQUEOUS SLURRY COATING SYSTEM FOR ALUMINIDE COATINGS

[75] Inventors: Michael S. Milaniak, Middlefield; Dennis J. Orzel, Meriden; Foster P. Lamm, South Windsor, all of Conn.; David E. DeSaulniers, North Hampton, Mass.

[73] Assignee: United Technologies Corporation, Hartford, Conn.

[21] Appl. No.: 63,342

[22] Filed: May 17, 1993

[51] Int. Cl.[5] ..... B05D 3/02; B05D 7/22

[52] U.S. Cl. ..... 427/229; 427/237; 427/259; 427/252

[58] Field of Search ..... 427/239, 229, 237, 252

[56] References Cited

U.S. PATENT DOCUMENTS

| | | | |
|---|---|---|---|
| 3,129,069 | 4/1964 | Hanink et al. | 29/183.5 |
| 3,141,744 | 7/1964 | Couch et al. | 29/164 |
| 3,625,750 | 12/1971 | Boranow et al. | 117/107.2 |
| 3,837,901 | 9/1974 | Seybolt | 117/107.2 |
| 3,873,347 | 3/1975 | Walker et al. | 117/71 |
| 4,004,047 | 1/1977 | Grisik | 427/142 |
| 4,031,274 | 6/1977 | Bessen | 427/229 |
| 4,070,507 | 1/1978 | Stueber et al. | 427/252 |
| 4,148,275 | 4/1979 | Benden | 427/237 |
| 4,156,042 | 5/1979 | Hayman et al. | 427/253 |
| 4,208,453 | 6/1980 | Baldi | 427/239 |
| 4,332,843 | 6/1982 | Ahuja | 427/237 |
| 4,347,267 | 8/1982 | Baldi | 427/237 |
| 4,350,719 | 9/1982 | Baldi | 427/253 |
| 4,352,840 | 10/1982 | Sievers | 427/248 |
| 4,528,215 | 7/1985 | Baldi et al. | 427/252 |
| 4,537,927 | 8/1985 | Baldi | 524/407 |
| 4,617,202 | 10/1986 | Baldi | 427/253 |
| 4,687,684 | 8/1987 | Restall et al. | 427/248 |
| 5,000,782 | 3/1991 | Olson et al. | 75/253 |
| 5,071,678 | 12/1991 | Grybowski et al. | 427/253 |

*Primary Examiner*—Janyce Bell
*Attorney, Agent, or Firm*—Charles E. Sohl

[57] ABSTRACT

An aqueous slurry process for producing a diffusion aluminide protective coating in superalloy articles, particularly on internal passages in superalloy articles.

Aqueous slurry containing a source of aluminum in particulate form, an inert ceramic particulate, a halide activator compound in particulate form and a viscous aqueous base dispersant is injected into the internal passage or otherwise coated on the internal surface to be protected. The coated article is heated to dry the slurry and remove the aqueous solvent base. The dried, coated article is diffusion heat treated between about 1,350° F. and 2,250° F. for a period of time between approximately 4 hours and 24 hours to transfer the aluminum to the surfaces of the passages and diffuse the aluminum into the substrate material to form the protective coating.

3 Claims, 2 Drawing Sheets

AQUEOUS SLURRY COATING SYSTEM FOR ALUMINIDE COATINGS

TECHNICAL FIELD

The present invention relates to a method for coating superalloy surfaces with a protective aluminide coating. In particular, the present invention is applicable for coating convoluted internal passageways in superalloy articles which are otherwise difficult to coat. The resultant protective aluminide coating increases the life of the articles by reducing the rate of oxidation and/or corrosion.

BACKGROUND ART

Aluminide coatings have been well known for a number of years and are widely used to protect metallic surfaces from oxidation and corrosion. Aluminide coatings are widely used in gas turbine engines because they are economical and because they add little to the weight of the part.

Aluminide coatings are formed by diffusing aluminum into the surface of the superalloy article to produce an aluminum-rich surface Myer. Exemplary patents showing diffusion aluminide coating processes include U.S. Pat. Nos. 3,625,750, 3,837,901, and 4,004,047. Typically, aluminide coatings are applied by a pack process. In a typical pack process, a particulate mixture, including an inert ceramic material, a source of aluminum, and a halide activating compound, is employed. The materials are well mixed and the parts to be coated are buried in the material. During the coating process an inert or reducing gas is flowed through the pack.

The pack coating process involves some complex reactions in which the halide reacts with a source of aluminum to produce an aluminum-halide vapor which circulates over the entire surface of the part. The vapor contacts the superalloy surface and decomposes, leaving the aluminum on the surface, while the halide is released to return to the aluminum source and continue the process. After the aluminum is deposited on the superalloy surface, it diffuses into the substrate. Diffusion is promoted by conducting the process at temperatures typically on the order of 1,500° F. to 2,000° F.

In the case of nickel-base superalloys, which am the most widely used type of superalloys, and which are used extensively in gas turbine engines, the predominant material found in the aluminide layer is NiAl which is formed near the surface. Other nickel aluminide compounds are often found further below the surface, as are compounds with aluminum and the other alloying elements found in a superalloy, including, e.g., cobalt, chromium, titanium, and refractory materials such as tungsten, tantalum, and molybdenum.

In gas turbine engines the turbine blades are invariably air-cooled to permit operation of the engine at higher temperatures. The cooling air is derived from air which is pressurized by the compressor section of the engine. As engine operating conditions increase with more modem engines, the temperature of the cooling air has gradually increased to the point where such "cooling" air may actually have temperatures as high as 1,000° F. It has been observed that such high temperature cooling air causes an undesirable rate of oxidation on the internal cooling passages of the turbine blades and other air-cooled gas turbine engine hardware.

Attempts have been made to coat the surfaces of these internal passages by a so-called out-of-pack aluminide coating process as shown, for example, in the U.S. Pat. No. 4,347,267. According to this process, aluminum halide gases generated by a pack composition of the type previously described are caused to flow through the cooling passages in the turbine blade while the blade is held in a fixture. While this is a relatively successful solution to the problem, it is costly and time consuming because it usually requires a separate step in the coating process.

It is also known to fill the internal passageways in the turbine blade with a powder pack material itself and coat the internal passage surfaces during the same coating process which is used to coat the outside of the blade. This is a problematic approach inasmuch as it very difficult to completely fill the complex internal passageways in a modem gas turbine engine blade with a powder material and it is even more difficult to completely remove the powder material from the surfaces after the coating process is complete.

DISCLOSURE OF INVENTION

The present invention provides a process for applying the powder pack material by coating the surfaces of the cooling passages of gas turbine engine hardware with a slurry of the powder. According to the invention, a source of aluminum, a halide activator, and an inert ceramic powder material are incorporated in an aqueous-base dispersant to form the slurry. The slurry is injected into the internal cooling passages to coat the surfaces of the passages and is then drained to remove excess material from the passages. The coated articles are heated at a temperature below 212° F. to remove the aqueous solvent from the dispersant, leaving behind the aluminum source, the halide activator compound, and the inert ceramic particles dispersed in a hardened organic matrix on the internal surfaces of the passageways. The articles whose internal passages have thus been coated are then heated to a temperature between 1,350° F. and 2,250° F. for about 4 to about 20 hours to decompose the matrix coating material. The halide activator compound and the source of aluminum interact to produce aluminum halide vapors which deposit aluminum on the surface of the internal passages. The aluminum diffuses into the substrate material to provide the desired protective coating.

The slurry components are selected to interact and provide the desired coating. Thus, for example, a number of aluminum sources are possible for use with the present invention. For example, pure aluminum powder may be used. Alloys of aluminum may also be used; for example, aluminum 10% silicon is used in conventional pack aluminide coatings, and it will function well in the present invention. U.S. Pat. No. 5,000,782 describes the use of an aluminum-yttrium-silicon alloy containing from 2 to 20 weight percent yttrium, from 6 to 50 weight percent of a material selected from the group consisting of silicon, chromium, cobalt, nickel, titanium, and mixtures thereof, balance aluminide. In this latter instance, the resultant aluminide coating contains a mixture of aluminum and yttrium. The yttrium provides benefits in oxidation resistance. Finally, aluminum compounds may be used. For example. $Co_2Al_5$, CrAl, and $Fe_2Al_5$ are known as sources of aluminum in diffusion coating processes and will work well in the present invention.

The halide activator compound can be any one of a large number of halide compounds including, e.g., aluminum fluoride, sodium fluoride, sodium chloride, sodium bromide, sodium iodide, ammonium fluoride, ammonium chloride, potassium fluoride, potassium chloride, potassium bromide, and potassium iodide. Mixtures of these halide compounds may also be used, as well as complex compounds such as $Na_3AlF_6$. These activator compounds are described in U.S. Pat. No. 4,156.042.

As those skilled in the an will appreciate, there is an interaction between the source of aluminum, the halide compound, and the temperature used during the process. Various sources of aluminum will provide different amounts of aluminum at a given temperature. Likewise, various halide compounds will be more or less effective in transporting this aluminum to the surface to be coated. The skilled artisan can readily determine, without undue experimentation, the balance between the aluminum source and the halide activator to produce a desired thickness of coating at a particular temperature within a particular time.

The inert ceramic particulate material may likewise be selected from a large group of possible materials. Inert ceramic particulate in the form of very fine particles, particles ranging from less than five microns average diameter to as much as −325 mesh particle size, but preferably less than 30 microns average diameters, is used. The purpose of the inert particles is to separate the aluminum source particles as they lay on the surface and prevent them from touching each other and sintering together. By eliminating sintering, the high surface area of the aluminum source material is maintained, providing a relatively high and uniform rate of coating formation. It also helps in preventing the aluminum source particles from bonding or fusing to the surface of the passageways to be coated, thus, making the removal of the residue after the coating process much easier.

The previously-mentioned particulate materials, along with an organic thickener, are dry mixed to assure uniform particle distribution and breakup of the thickener into small particles for better dissolution. The mixture is formed into a slurry by adding water and stirring. We have used A15C, a form of methyl cellulose produced by the Dow Chemical Company, Midland, Michigan, as the thickener, but we believe that many other cellulose-base compounds may be used with equal success. The key requirements of the organic thickener are that it provide the desired degree of viscosity increase, that it degrade or decompose at moderate temperatures, i.e., below 1,000° F. and preferably below 600° F., that it leave no residue on the surface to contaminate the surfaces after degradation and breakdown, that it not produce excessive by-products during decomposition, that it leave a network of interconnected voids to facilitate easy removal of the powder pack material, and that it contain no chemical species which are harmful to superalloys. Species harmful to superalloys include heavy metals such as bismuth, lead, and tin and elements such as sulfur which can promote corrosive attack.

Preliminary investigations of a slurry prepared using Kelzan®, as the organic binder indicate that the slurry has a longer shelf life and is less likely to undergo a reaction between free aluminum and water than a slurry prepared using methyl cellulose. Kelzan®, available from Kelco, a division of Merck and Company, is a cellulose-base material derived from kelp. No tests have been run to study coating application process characteristics or ease of removal of the dried slurry after the coating cycle, so the overall suitability of this slurry is presently unknown.

The amount of organic thickener employed must be sufficient to produce a coating viscosity at room temperature ranging from about 100 to 1000 centipoise. This is a viscosity which is on the order of that observed in molasses or honey, also at room temperature, and provides a slurry which can be easily injected into the passages under moderate pressure, but which will not readily flow out of the passages. At the same time, the slurry is fluid enough to assure that no bubbles are left as the hollow article is filled. This is done by forcing the slurry to always flow upward as it fills the cavity with gravity assuring completed filling of all parts of the cavity.

We have determined that a desirable slurry composition consists of 10% to 20% inert ceramic particulate material, 0.1% to 10.0% halide activator, 0.1% to 10.0% $Al_2O_5$, 2.0% to 2.5% organic thickener, balance water, with all quantities expressed in weight percent.

The internal passages of the parts are filled by injecting the slurry into the passageways. The parts are then heated at a low temperature to remove the water from the slurry, leaving a filler which contains the particulate materials imbedded in the organic material. The filler is effectively the same as the prior art powder pack used for applying the same coating to the external surfaces of the parts.

We have eliminated the preliminary heating step by heating the filled articles directly to the elevated coating temperature 1,350° F. 2,250° F. with mixed results. Often the coatings are useable but sometimes we observe that the water has boiled before evaporation and has removed some of the coating material from the passageway surfaces, leaving bare spots or undesirable variations in the coating. Thus, we prefer the preliminary drying operation.

In broad terms, the coating process consists of heating the parts to a temperature between 1,350° F. and 2,250° F. for a period of time sufficient to allow aluminum to diffuse into the surfaces of the internal passages to a depth which provides a coating of the desired thickness and durability. In practice we have used a one-step heat treatment and a two-step heat treatment, both followed by a cleaning of the article and a diffusion heat-treat step.

In the one-step heat treatment, the parts having coated internal passageways are heated to a single temperature within the temperature range and held at that temperature while aluminum deposition and diffusion occurs. In the two-step coating process the articles are heated to a first relatively low temperature 1,350° F. to 1,650° F. and then to a second higher temperature, 1,750° F. to 2,250° F. In both the one-step and two-step processes, the articles are then readily cleaned using a pressurized air blast and a water flush to remove the remnants of the slurry coating and are given a diffusion heat treatment at about 1,975 ° F. in hydrogen for about four hours. All heat treatment operations are preferably performed in an inert or reducing atmosphere, such as argon, hydrogen, or mixtures thereof.

These, and other features and advantages of the invention, will be apparent from the description of the Best Mode, read in conjunction with the drawings.

BEST MODE FOR CARRYING OUT THE INVENTION

The invention will be illustrated with an example which describes the process which applicants now use to coat internal cooling passages in gas turbine engine parts. The slurry mixture containing the ingredients set forth in Table I is prepared:

TABLE I

| Total Grams | Ingredient |
|---|---|
| 600 | $Co_2Al_5$ |
| 120 | $NH_4Cl$ |
| 200 | $Al_2O_3$ |
| 108 | Methyl Cellulose |
| 2,972 | $H_2O$ |

Figure 1:
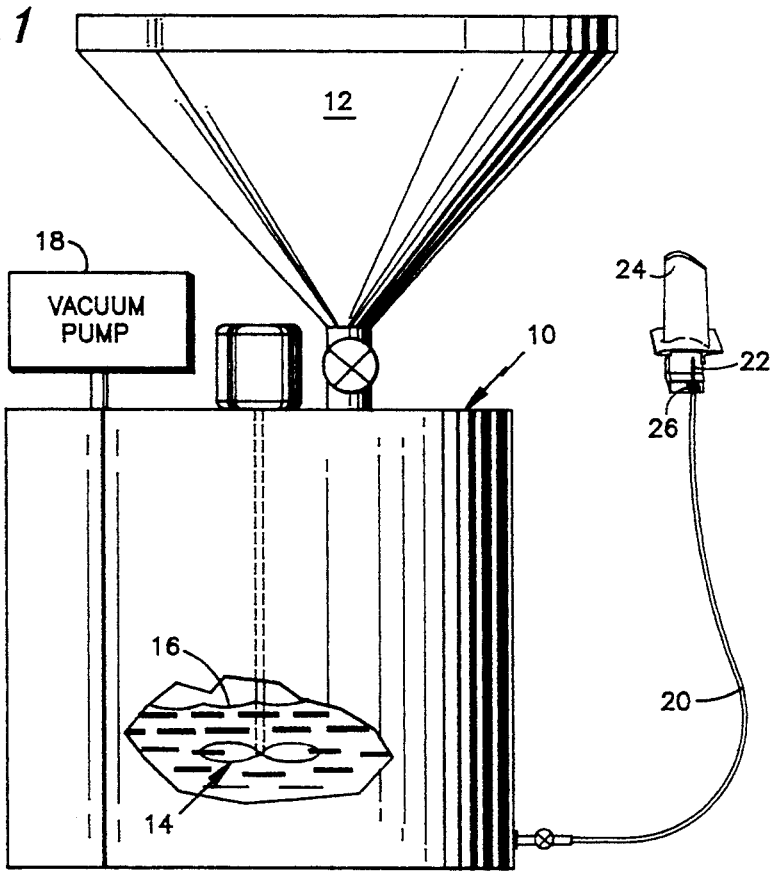
FIG. 1 is a sketch of the apparatus used to prepare the slurry and inject the slurry into a hollow gas turbine engine turbine blade.

Referring to FIG. 1, the solid materials were fed into a rotary blender 10 from a feed hopper 12, and thoroughly dry mixed using an air-powered stirrer 14. The water was added and stirring was continued for about 30 minutes until a slurry 16 was formed which reached a viscosity in the desired range of 100 to 1,000 centipoise. A vacuum pump 18 was used to draw a partial vacuum on the blender during mixing to minimize air bubble formation in the slurry.

After the mixing was complete, air at about 20 psi was introduced into the blender 10 above the slurry, causing the slurry to move out of the blender through a flexible hose 20 which is attached to the bottom of the blender 10. An injection needle 22 at the end of the flexible hose 20 was inserted into the passageway of the blade 24 to be fried. The injection needle 22 has at its base a rubber stop 26 which seals off the passageway as the blade is filled.

Figure 2A:
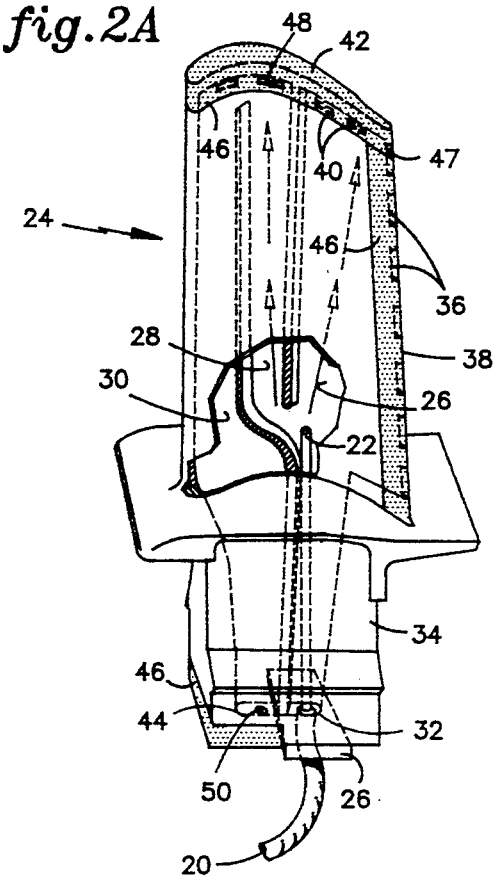
FIG. 2A and 2B are a series of two sketches showing how the slurry is injected into a hollow blade so that the hollow blade is filled without any air products.
Figure 2B:
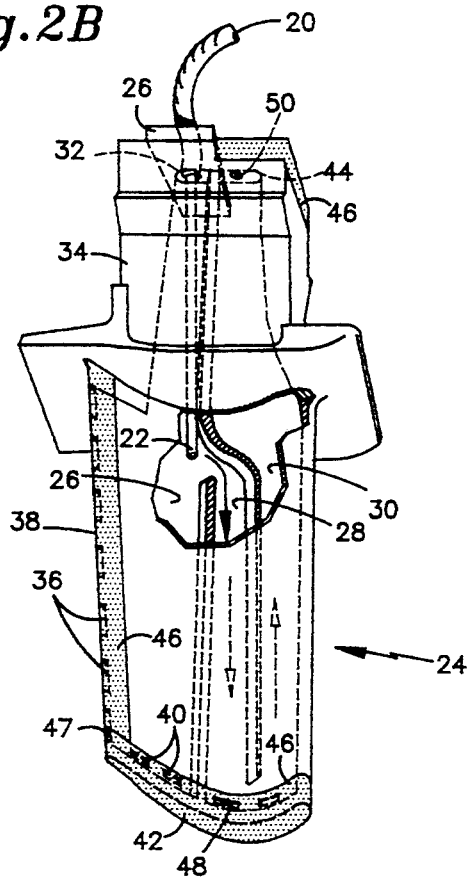

The filling process for this blade, which is typical of a hollow blade having a convoluted internal cooling passage, can be understood through reference to FIG. A and FIG. 2B. As shown in FIG. 2A, the blade 24 has cooling passages 26, 28, 30 for the trailing edge, the center, and the leading edge of the blade, respectively. Cooling air enters the blade 24 through the openings 32, 44 at the root 34 of the blade, flows through the cooling passages 26, 28, 30, and escapes through holes 36 at the trailing edge 38, and through holes 40 at the blade tip 42.

At the start of the filling process, the slurry 16 is pumped through the needle 22 and rises to fill the cooling passages 26 and 28. Tape 46 is placed over the trailing edge cooling holes 36, the tip escape holes 40, and the opening 44 to control the escape of slurry from those holes. Holes 47, 48, 50 are poked through the tape to allow trapped air to escape, and to release small amounts of slurry in order to measure the progress of the filling operation.

When the passages 26, 28 have been filled by upward flow, as discerned by escape of slurry through the holes 47, 48 in the tape, the blade 24 and needle 22 are inverted as shown in FIG. 2B. The filling process is continued so that the passage 30 is fried, again by upward flow, until slurry escapes through the hole 50 in the tape.

We have employed manual filling to-date. In a production application we anticipate that automation would be employed and that a robotic and would move the blade as appropriate to cause the blade and its convoluted passageways to be completely filled with the slurry without the formation of air bubbles which could interfere with the coating process.

The filed blade was heated at about 160° F. for about two hours to dry the slurry. The dried blade was then heated in a furnace to cause the diffusion coating process to occur. It could also be placed in a conventional diffusion aluminide powder pack so that the outside of the blade is coated at the same time as the inside of the blade. In any event a reducing or inert atmosphere is employed during the coating process.

The coating process employed a temperature of about 1,400° F.±25° F. for a period of about 4 hours. The coating residue was removed by directing compressed show air into the cooling passages, followed by a water rinse. The aluminide coating was then diffused at 1,975° F.±25° F. for four hours in argon.

Figure 3:
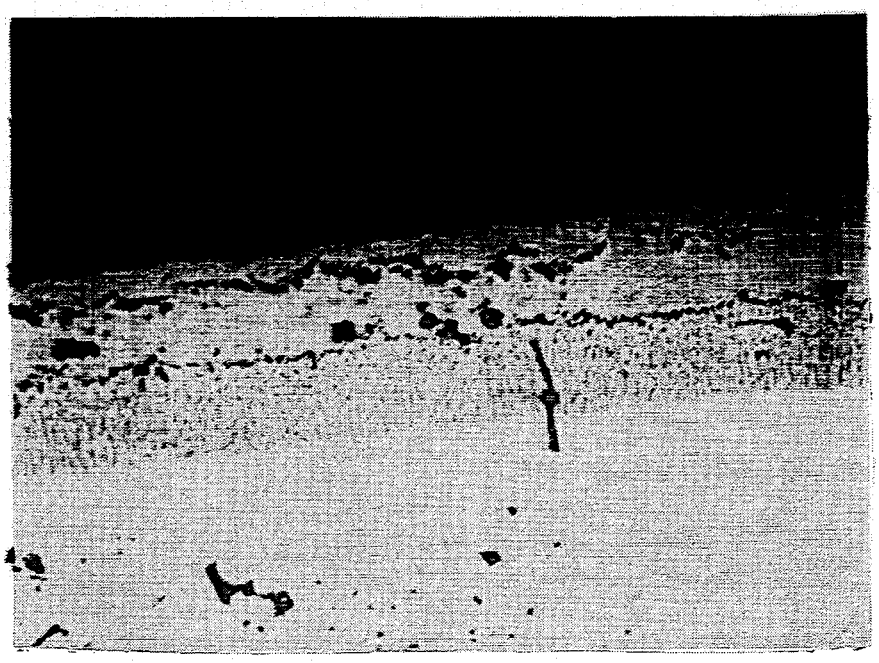
FIG. 3 is a photomicrograph of a protective coating deposited on the inside surfaces of a gas turbine engine turbine blade.

The coated blade was then sectioned to evaluate the coating. FIG. 3 shows that the coating is typical of coatings made using the prior art process.

Although this invention has been shown and described with respect to detailed embodiments thereof, it will be understood by those skilled in the art that various changes, omissions, and additions in form and detail thereof may be made without departing from the spirit and scope of the claimed invention.

We claim:

1. A method for forming a high temperature oxidation resistant protective coating on internal surfaces of a hollow superalloy article which comprises:

a. providing a slurry consisting of a source of aluminum in particulate form, an inert ceramic particulate, a halide compound activator in particulate form, and an aqueous base dispersant which includes an organic thickening agent and has a viscosity of from about 100 centipoise to 1,000 centipoise;

b. filling the internal cavity of the article with the slurry;

c. evaporating the solvent to leave the aluminum source particles, the inert ceramic particles and the halide compound particles in an organic matrix, said matrix resulting from the organic thickening agent; and d. heating the filled superalloy article to a temperature of between about 1,300° F. and 2,300° F. for a period of between about 1 and about 20 hours in a non-oxidizing atmosphere to decompose the organic matrix, and leave a network of voids, and to permit the halide activator to interact with the aluminum source to generate aluminum compound vapors which coat the internal surfaces and to diffuse into the surface to produce an integral aluminide coating.

2. The method as recited in claim 1 wherein the slurry has a viscosity of 100 to 1,000 centipoise.

3. The method as recited in claim 1 wherein the composition of the slurry comprises of 10% to 20% by weight aluminide compound, 0.1% to 10.0% by weight halide activator, 0.1% to 10.0% by weight inert ceramic particulate material, 2.0% to 2.5% by weight organic thickener, balance water.

* * * * *